US005842234A

United States Patent [19]

Dixon

[11] Patent Number: 5,842,234

[45] Date of Patent: Dec. 1, 1998

[54] CHILD ACCOMMODATING TOILET SEAT LID

[76] Inventor: Gerald Eugene Dixon, 16147 SE. Sunflower Rd., Leon, Kans. 67074

[21] Appl. No.: 862,193

[22] Filed: May 23, 1997

[51] Int. Cl.[6] ..... A47K 13/06

[52] U.S. Cl. ..... 4/235; 4/240; 16/334

[58] Field of Search ..... 4/235, 236, 239, 4/240; 16/334

[56] References Cited

U.S. PATENT DOCUMENTS

| | | | |
|---|---|---|---|
| 2,026,024 | 12/1935 | Dullere | 4/236 |
| 4,461,046 | 7/1984 | Adams | 4/235 |
| 5,412,842 | 5/1995 | Riblett | 16/334 |

*Primary Examiner*—Robert M. Fetsuga
*Attorney, Agent, or Firm*—Kenneth Jack

[57] ABSTRACT

A toilet seat lid for accommodating small children, the toilet seat lid comprising a first cover plate, the first cover plate shaped and sized to overlie a common toilet seat, the rearward end of the first cover plate having a first pivotal attachment; the first cover plate having a child seat aperture therethrough; a second cover plate pivotally attached by a second pivotal attachment to the upper surface of the first cover plate so that the second cover plate may cover the child seat aperture of the first cover plate, and extend upwardly from the upper surface of the first cover plate, exposing such child seat aperture; the second pivotal attachment, capable of alternately fixedly securing the second cover plate in its open or closed positions.

1 Claim, 4 Drawing Sheets

CHILD ACCOMMODATING TOILET SEAT LID

FIELD OF THE INVENTION

The instant invention relates to articles and apparatus for modifying and adapting adult-sized toilets for use by small children. In particular, the present invention relates to toilet seat lids modified to make such an adaptation.

BACKGROUND OF THE INVENTION

A standard sized flush toilet typically has an oval shaped toilet seat having an outside peripheral shape and an aperture, shaped and sized for use by an adult. Small children cannot use such toilets and toilet seats without propping themselves up with both arms; and many small children are not capable of doing so.

Difficulties which arise when a small child attempts to use an adult sized toilet have led to usage of smaller non-flush toilets in the bathrooms of families with small children. Usage of such smaller non-flush toilets presents additional disadvantages because such toilets will not flush and have to be manually emptied. Another disadvantage of such smaller non-flush toilets is they present an additional article in the bathroom which must be cleaned. Another disadvantage of such smaller non-flush toilets is that they take up additional bathroom space. Thus, a need exists for an article or apparatus for adapting a standard adult-sized toilet and toilet seat for usage by small children, allowing the benefit of flushing water in both usages, eliminating extra cleanup time and effort, and eliminating extra space usage.

The instant inventive child accommodating toilet seat lid satisfies all such needs.

PRIOR ART PATENTS

U.S. Pat. No. 4,461,046 issued Jul. 24, 1984, to Adams discloses a child accommodating toilet seat cover.

U.S. Pat. No. 2,219,643 issued Oct. 29, 1940, to Zaio discloses a child accommodating toilet seat cover.

U.S. Pat. No. 2,434,889 issued Jan. 20, 1948, to Sacia discloses a child accommodating toilet seat cover.

U.S. Pat. No. 2,461,160 issued Feb. 8, 1949, to Joyce discloses a child accommodating toilet seat cover.

U.S. Pat. No. 2,494,813 issued Jan. 17, 1950, to Hughes discloses a child accommodating toilet seat cover.

U.S. Pat. No. 2,820,969 issued Jan. 28, 1958, to Wedge discloses a child accommodating toilet seat cover.

U.S. Pat. No. 426,287 issued Apr. 22, 1890, to Larkin discloses a child accommodating toilet seat cover.

U.S. Pat. No. 1,739,001 issued Dec. 10, 1929, to Justus discloses a child accommodating toilet seat cover.

U.S. Pat. No. 3,609,775 issued Oct. 5, 1971, to Leiter, et al., discloses a child accommodating toilet seat cover.

U.S. Pat. No. 2,721,531 issued Oct. 25, 1955, to Findley, Jr., discloses a child accommodating toilet seat cover.

U.S. Pat. No. 2,808,874 issued Oct. 8, 1957, to Liebling discloses a child accommodating toilet seat cover.

None of the above disclosed patents teaches or discloses the novel, inventive, useful and unique aspects and features of the present invention.

SUMMARY OF THE INVENTION

The instant inventive child accommodating toilet seat cover has an overall shape, and is hinged and pivotally attached to a toilet the same as a common toilet seat cover; the cover comprising a lower apertured lid and an upper pivoting cover plate. The aperture of the lower apertured lid is oval in shape, and is positioned and sized allowing a small child to sit upon the upper surface of the lid, utilizing the lid as a toilet seat just as an adult would utilize the standard sized toilet seat underlying the lid. The cover plate covers the apertured lid in much the same way that a standard toilet seat cover covers a toilet seat. The cover plate is rearwardly hinged so that the plate may pivot from a first position wherein it overlies and covers the aperture of the child accommodating toilet seat, to a second position wherein the lid extends upward, exposing the aperture for use by a child.

In order to prevent the pivoting cover plate from falling downward from its open position, and in order to prevent the cover plate from falling rearward upon raising the underlying child accommodating lid, each cover plate hinge includes a round-headed spring driven detent pin which engage pin receiving apertures for selectively holding the cover in and upward open position or in a downward closed position.

Accordingly, it is an object of the present invention to provide a toilet seat cover, for covering a standard adult-sized toilet seat, the toilet seat cover being adapted for usage by a small child as a secondary toilet seat, the toilet seat cover having a secondary lid for covering the child toilet seat, the secondary lid having a spring driven detent pin mechanism for selectively holding the lid either in a closed or an open position.

Other and further objects, benefits, and advantages of the present invention will become known to those skilled in the art upon review of the Detailed Description which follows, and upon review of the appended drawings.

DETAILED DESCRIPTION OF THE PREFERRED EMBODIMENT

Figure 1:
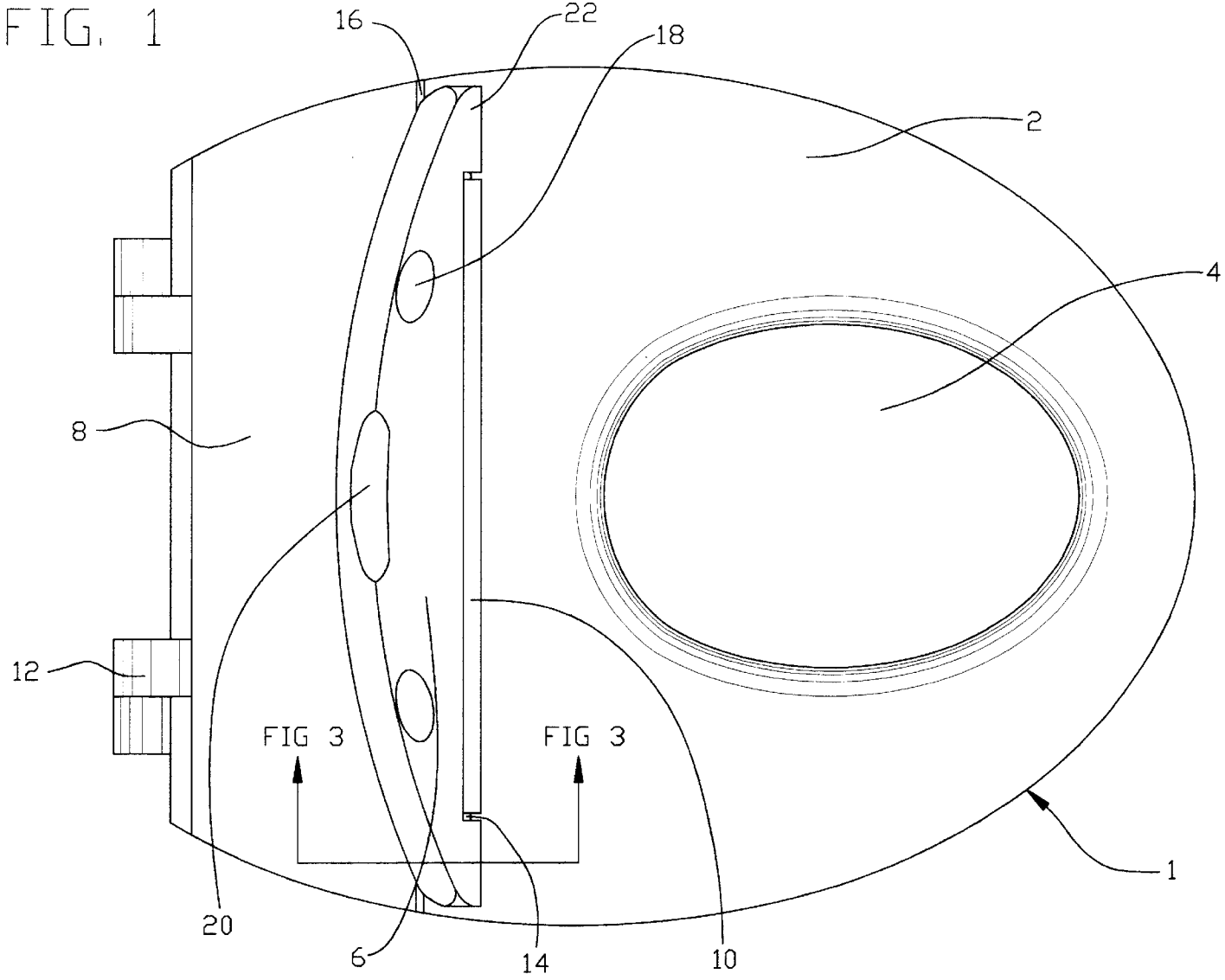
FIG. 1 is a view from above of the child accommodating toilet seat cover in its open position.
Figure 5:
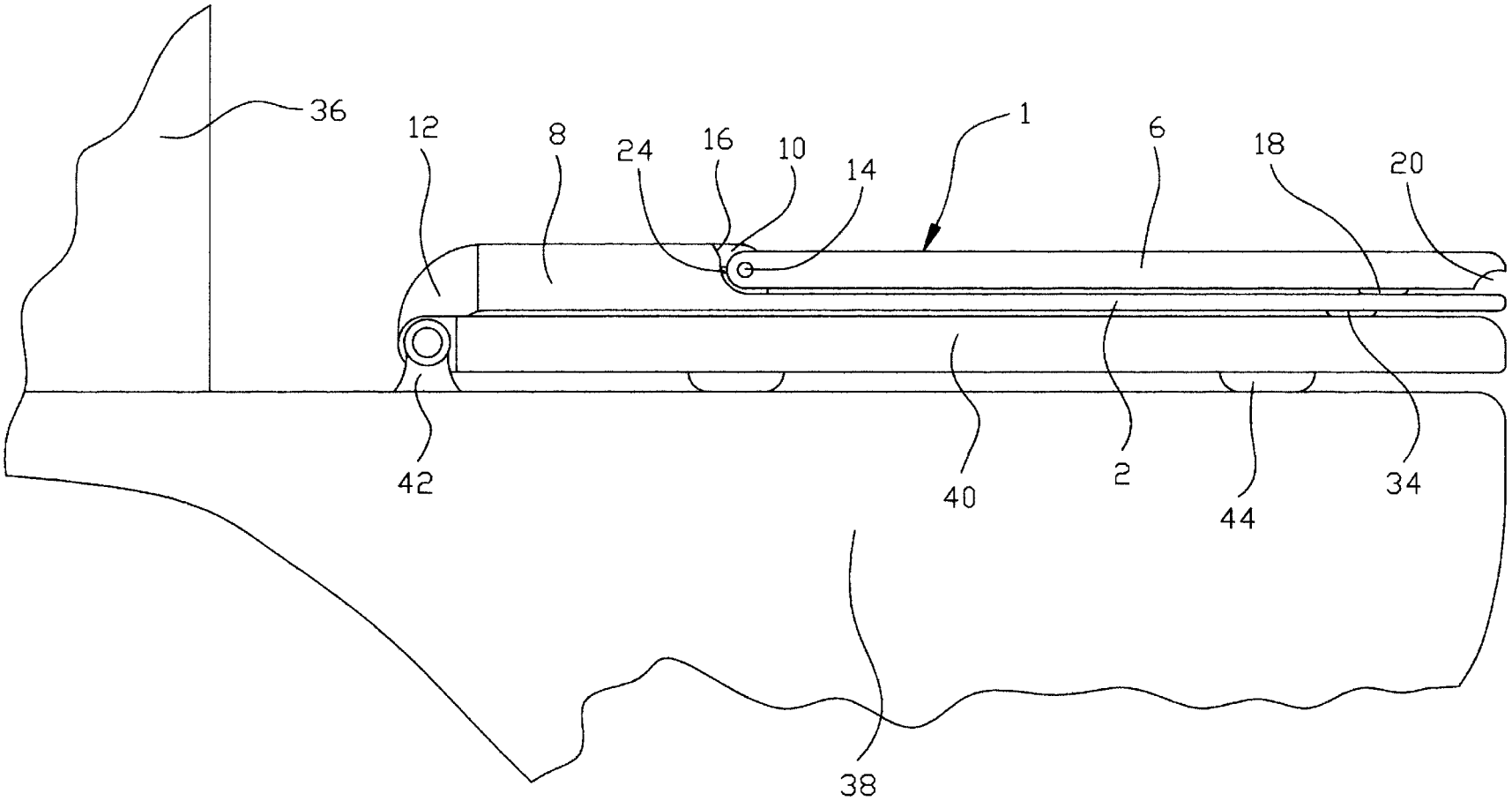
FIG. 5 is a sideview of the child accommodating toilet seat cover, shown installed upon a standard toilet and toilet seat.

Referring now to the drawings, and in particular to FIG. 5, a partial sideview of a porcelain flush toilet 38 is shown, the flush toilet 38 having a rearward porcelain water tank 36. A standard oval adult-sized toilet seat 40 is pivotally attached to the flush toilet 38 by means of a toilet seat hinge 42. In common usage, such toilet seats as the adult-sized toilet seat 40 are inconvenient for use by small children, they having to prop themselves up with their arms in order to avoid falling downward into the flush toilet 38. Referring simultaneously to FIGS. 1 and 5, the child accommodating toilet seat cover 1 solves this problem by modifying the toilet seat lid 2 to include an oval aperture 4, allowing a child to be seated on the upper surface of the toilet seat lid 2, and there utilize the toilet seat lid 2 in much the same manner as an adult utilizing the underlying adult-sized toilet seat 40.

Still referring to FIGS. 1 and 5, the oval aperture 4, when not in use, is covered by a secondary lid 6. While the toilet seat lid 2 and the secondary lid 6 are in their lowered positions, the upper surface of the secondary lid may be utilized as a seat much like a standard toilet seat lid may be utilized. When the child accommodating toilet seat cover 1 is utilized in such a manner, the weight of the person seated on the upper surface of the secondary lid 6 is transferred to the toilet 38 through secondary lid support feet 18, through toilet seat lid support feet 34 and through adult toilet seat feet 44. Pivotal attachment of the child accommodating toilet seat cover 1 to the toilet 38 is accomplished by means of a hinge 12.

Referring further to FIGS. 1 and 5, in order for a child to utilize the oval aperture 4 of the toilet seat lid 2, either the child, or a person helping the child, inserts fingertips into the finger indentation 20 at the forward end of the secondary lid 6 and raises the secondary lid 6 in pivoting motion upward, exposing the oval aperture 4 for use by the child.

Figure 2:
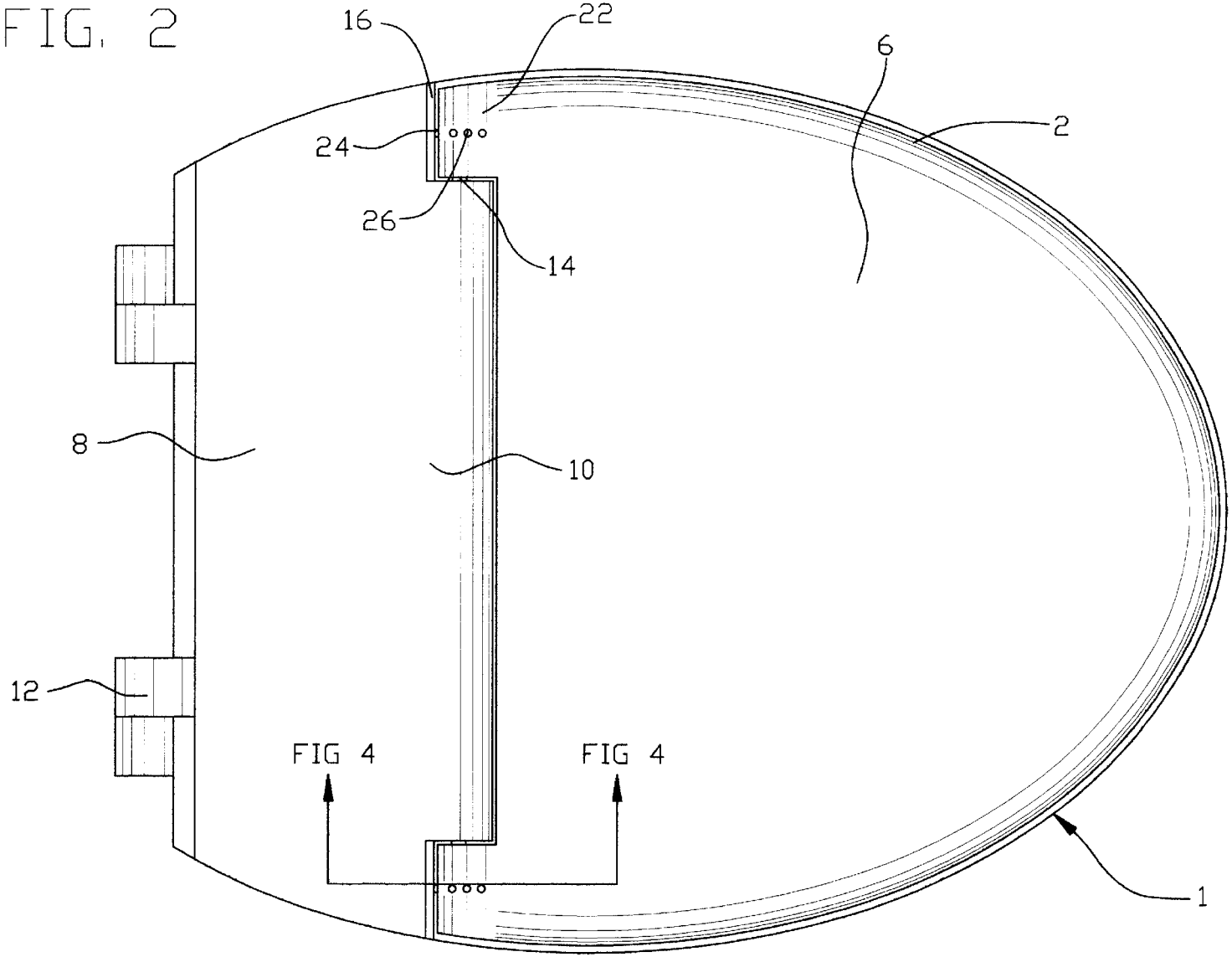
FIG. 2 is a view from above of the child accommodating toilet seat cover in its closed position.
Figure 3:
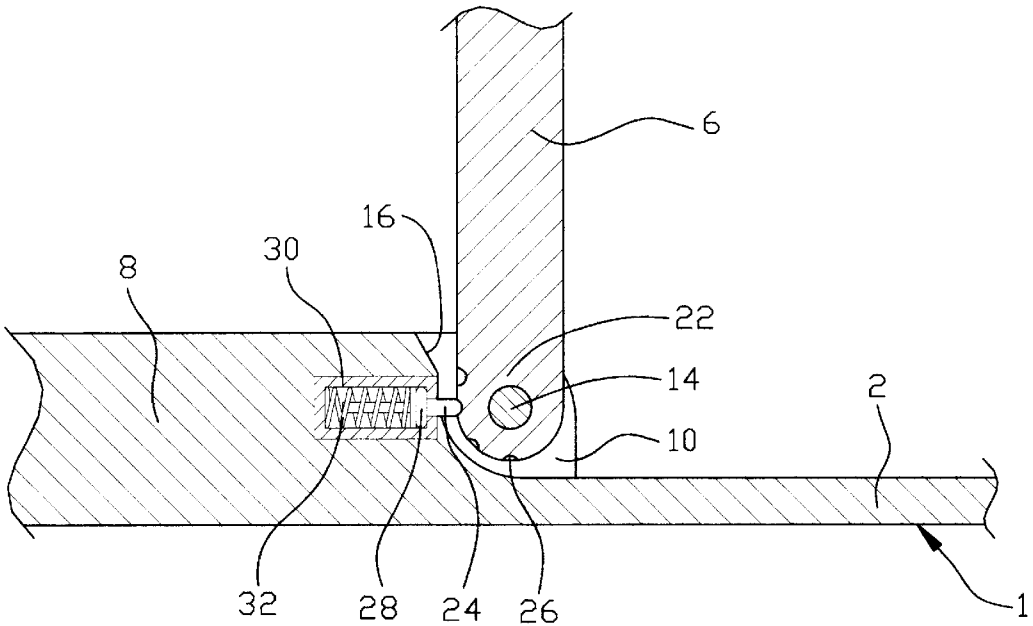
FIG. 3 is a side cutaway view of the child accommodating toilet seat cover in its open position.
Figure 4:
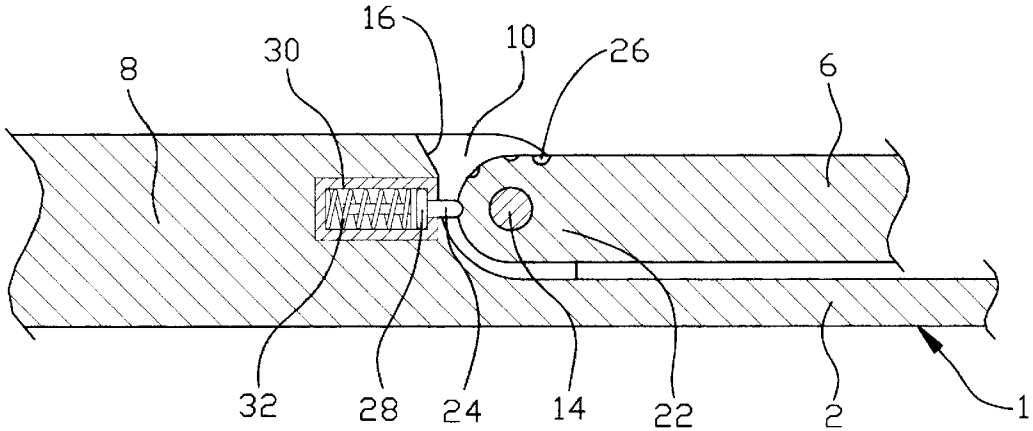
FIG. 4 is a side cutaway view of the child accommodating toilet seat cover in its closed position.

Referring to FIG. 2, the toilet seat lid 2 has a rearward raised section 8; and extending forwardly from the rearward raised section 8 is a downwardly curved axle support section 10. The secondary lid has a pair of rearward axle receiving tabs 22 for receiving and rotatably supporting, referring to FIGS. 2 and 4 simultaneously, a pair of axles 14. Referring simultaneously to FIGS. 2, 3, and 4, the rearward surfaces of the axle receiving tabs 22 are semi-circular, allowing for pivotal rotation of the secondary lid 6 about the axles 14.

Referring simultaneously to FIGS. 2 and 4, each forward surface 16 of the rearward raised section 8 has mounted therein a spring driven round-headed detent pin 24, such pin being mounted and aligned so that its round head successively engages with detent pin receiving depressions 26. While the secondary lid 6 is in its closed position the rounded heads of the detent pins 24 engage the lowermost detent pin receiving depressions 26, securing the secondary lid 6 in its closed position. While the secondary lid 6 is so secured, the toilet seat lid 2 or the lid and the adult toilet seat 40 may be raised to an upright position without the secondary lid 6 falling in independent pivotal motion rearward. Upon raising the secondary lid 6, the rounded heads of the detent pins 24 engage with either the third or the fourth detent pin receiving depressions 26, securing the secondary lid 6 in its upright position, for prevention of falling. Intermediate detent pin receiving depressions progressively engage the detent pins 24 as the second lid 6 moves in pivotal motion, preventing the secondary lid 6 from forcefully falling.

Referring to FIGS. 3 and 4, the round-headed detent pins 24 are supported for alternate rearward and forward motion within cylindrical detent pin housings 30, each detent pin housing 30 having a rearward floor and a forward inwardly turned annular pin retaining flange. Each detent pin 24 is driven forward by a spring 32, and each detent pin 24 has a moisture sealing washer 28, composed of rubber.

While the principles of the invention have been made clear in the above illustrative embodiment, those skilled in the art may make modifications in the structure, arrangement, portions and components of the invention without departing from those principles. Accordingly, it is intended that the description and drawings be interpreted as illustrative and not in the limiting sense, and that the invention be given a scope commensurate with the appended claims.

I claim:

1. A toilet seat lid for accommodating small children, the toilet seat lid comprising:

(a) a first cover plate, the first cover plate having an upper surface, a lower surface, an outer peripheral edge, a forward end, and a rearward end, the first cover plate being shaped and sized to overlie and cover a common toilet seat, the rearward end of the first cover plate having a first pivotal attaching means, such first pivotal attaching means being capable of pivotally attaching the first cover plate to a common flush toilet, such toilet having said common toilet seat and a water tank, so that the first cover plate may pivot from a first position wherein the lower surface of the first cover plate overlies the toilet seat, to a second position wherein the upper surface of the first cover plate rests against the water tank; the first cover plate having a child seat aperture therethrough extending from its upper surface to its lower surface, the child seat aperture being positioned, sized and shaped so that while the first cover plate is in such a first position, a child may sit upon the upper surface of the first cover plate, and such child may utilize the first cover plate as a second toilet seat;

(b) a second cover plate having an upper surface, a lower surface, an outer peripheral edge, a forward end, and a rearward end, the rearward end of the second cover plate being pivotally attached by a second pivotal attaching means to the upper surface of the first cover plate so that the second cover plate may pivot from a first position wherein the second cover plate overlies and covers the child seat aperture of the first cover plate, to a second position wherein the second cover plate extends upwardly from the upper surface of the first cover plate, exposing such child seat aperture; and;

(c) position fixing means, the position fixing means being capable of alternately fixedly securing the second cover plate in its first or second positions, the position fixing means being mounted upon the first cover plate and positioned thereon so that it may engage the second cover plate, alternately affixing the second cover plate in either its first or second positions; the first pivotal attaching means comprising a first hinge having a first and a second fixed attaching means, the first fixed attaching means of the first hinge being adapted for fixed attachment to the common flush toilet and the second fixed attaching means being adapted for fixed attachment to the rearward end of the first cover plate; the second pivotal attaching means comprising a second hinge, the second hinge having a third fixed attaching means and a fourth fixed attaching means, the third fixed attaching means fixedly attaching the second hinge to the first cover plate, and the fourth fixed attaching means fixedly attaching the second hinge to the second cover plate; the position fixing means comprising a spring driven detent pin, the spring driven detent pin having a first end and a second end, the first end of the spring driven detent pin being slidably mounted upon the third fixed attaching means so that the second end of the spring driven detent pin may alternately engage and release the fourth fixed attaching means; the third fixed attaching means comprising a forward facing wall upwardly extending from the upper surface of the first cover plate; the fourth fixed attaching means comprising a curved clevice joint having an exterior radial surface, the exterior radial surface of the curved clevice joint having a plurality of detent pin receiving depressions; the second hinge further comprising a cylindrical axle pivotally interconnecting the third fixed attaching means with the fourth fixed attaching means; the position fixing means further comprises a cylindrical detent pin housing having a rearward floor, and having a forward inwardly turned and annular detent pin retaining flange, and further comprising a pin driving spring mounted within an interior of the detent pin housing, wherein the first end of the detent pin is mounted within such interior so that the second end of the detent pin may be driven forwardly by the spring.

* * * * *